US005813481A

United States Patent [19]

McLeod et al.

[11] Patent Number: 5,813,481

[45] Date of Patent: Sep. 29, 1998

[54] SYSTEM FOR IN SITU REPLACEMENT OF CUTTING MEANS FOR A GROUND DRILL

[75] Inventors: Gavin Thomas McLeod, Bullcreek; Matthew Vance Egan, Leeming, both of Australia

[73] Assignee: Down Hole Technologies, Ltd., Myaree, Australia

[21] Appl. No.: 473,879

[22] Filed: Jun. 7, 1995

Related U.S. Application Data

[62] Division of Ser. No. 433,402, Jul. 7, 1995, Pat. No. 5,662, 182.

[30] Foreign Application Priority Data

| | | | |
|---|---|---|---|
| Jun. 16, 1993 | [AU] | Australia | PL 9407 |
| Mar. 2, 1994 | [AU] | Australia | PM 4158 |
| Mar. 2, 1994 | [AU] | Australia | PM 4159 |

[51] Int. Cl.[6] ..... E21B 10/64

[52] U.S. Cl. ..... 175/52; 175/259

[58] Field of Search ..... 175/52, 107, 260, 175/261, 259, 258, 273, 292

[56] References Cited

U.S. PATENT DOCUMENTS

| | | | |
|---|---|---|---|
| 2,068,704 | 1/1937 | Powell . | |
| 2,345,699 | 4/1944 | Camp . | |
| 2,358,466 | 9/1944 | Miller . | |
| 2,640,546 | 6/1953 | Baker . | |
| 2,842,343 | 7/1958 | Church et al. . | |
| 3,437,159 | 4/1969 | Link et al. . | |
| 3,603,411 | 9/1971 | Link | 175/261 X |
| 3,603,413 | 9/1971 | Grill et al. | 175/261 |
| 3,692,126 | 9/1972 | Rushing et al. . | |
| 3,880,247 | 4/1975 | Harding | 175/260 |
| 3,955,633 | 5/1976 | Bowles . | |
| 4,281,722 | 8/1981 | Tucker et al. . | |
| 4,497,382 | 2/1985 | Nenkov . | |
| 4,651,837 | 3/1987 | Mayfield | 175/260 |
| 4,828,023 | 5/1989 | Leggett . | |
| 5,186,265 | 2/1993 | Henson et al. | 175/107 |
| 5,197,553 | 3/1993 | Leturno | 175/57 |
| 5,271,472 | 12/1993 | Leturno | 175/107 |

FOREIGN PATENT DOCUMENTS

| | | |
|---|---|---|
| 788637 | 1/1958 | United Kingdom . |
| 2181764 | 4/1987 | United Kingdom . |

OTHER PUBLICATIONS

PCT/SU89/00123; Feb. 1990; Grigorievich.

*Primary Examiner*—Frank Tsay

[57] ABSTRACT

An insert for releasably retaining drill bit segments in a ground drill takes the form of a cylindrical tube movable within the ground drill between an installation position and a retrieval position. A pair of opposing tapered peaks extends from the upstream end of the insert. Sides of the peaks slope sharply in a downstream direction and lead to flats separating the peaks. When a running tool with radially extending latch dogs travels down the drill, the latch dogs contact the peaks to cause the tool to rotate about its longitudinal axis. When the latch dogs hit the flats they engage the insert, pushing it down into the installation position and locking the bit segments into a cutting position. Another set of latch dogs provided on the tool can engage slots formed in the insert to pull the insert upwardly and release the bit segments.

11 Claims, 12 Drawing Sheets

22
62
65
66
70
72
77
78
80
82
84
86
88
90
92
94
96
98
100
102
104
106
108
110
112
114
36
74
68
76

SYSTEM FOR IN SITU REPLACEMENT OF CUTTING MEANS FOR A GROUND DRILL

This application is a divisional of pending patent application Ser. No. 08/433/402, filed Jul. 7, 1995 and entitled "System for in Situ Replacement of Cutting Means for a Ground Drill", now U.S. Pat. No. 5,662,182.

FIELD OF THE INVENTION

This invention relates to a system for in situ replacement of cutting means for a ground drill, and in particular, though not exclusively, to a system for the in situ replacement of drill bits and/or reamers of core sampling drills.

BACKGROUND OF THE INVENTION

In ground drilling it is customary to detachably fix a drill bit to a lower end of a drill string of a ground drill and rotate the drill string to effect drilling of a hole in the ground by the drill bit. A reamer is usually connected between the lower end of the drill string and the drill bit to ream the circumferential wall of a hole being drilled. The drill string is formed by screwing individual drill rods together. Drill rods usually come in fixed lengths of 1.5, 3 or 6 metres. As the drill progresses into the ground additional drill rods are screwed into the upper end drill string.

During drilling it will be necessary to replace the drill bit and reamer either as a result of dulling of the drill bit or due to variations in the sub strata. Although the drill bit must be replaced more often (usually at least six times more often) than the reamer.

In order to replace a drill bit or reamer the entire drill string must be pulled out of the ground rod by rod, the drill bit replaced, and the drill string reassembled, rod by rod as it is relowered into the ground to continue drilling. The need to fully withdraw, disassemble and reassemble the drill string when changing the drill bit/reamer is a slow and costly exercise, with the cost increasing as hole depth increases and the drill string becomes longer.

Several attempts have previously been made to overcome this problem at least insofar as drill bits are concerned by use of retractable drill bits which releasably engage the lower end of the drill string and can be disengaged and retracted through the drill string for changing while the drill string remains in situ, thereby avoiding the need to withdraw the drill string from the hole. However, these attempts have not proven to be commercially successful for various reasons including: being extremely complicated in design or application thereby resulting in a large number of failure modes and/or being to costly to manufacture or maintain in an operational state; being prone to fouling due to drilling fluid and contaminants burring or jamming segments of the drill bit; misalignment of drill bit segments upon engagement with the drill string; reduction in diameter of the core sample due to fixing of the drill bit to an inner tube of the drill string; reduction in penetration rate; and breaking of individual segments of the drill bit.

SUMMARY OF THE INVENTION

It is an object of the present invention to provide a system for in situ replacement of drill bits and/or reamers of a ground drill which attempts to overcome at least one of the above-described deficiencies in the prior art.

According to the present invention there is provided a system for in situ replacement of cutting means of a ground drill where the cutting means is composed of a plurality of segments, said system comprising:

a tubular member adapted for connection to a lower end of said ground drill, said tubular member provided with seating means formed circumferentially about an inner wall of said tubular member for seating said segments in a cutting position in which said segments can contact the ground;

a substantially cylindrical insert retained in said member, said insert being moveable between an installation position in which said insert locates said segments in said seating means and retains said segments in said cutting position between said insert and said member and, a retrieval position in which said insert is retracted to release said segments from between said insert and said member whereby said segments can be retrieved for replacement.

Advantageously said seating means comprises a series of tapered and flat surfaces formed on said inner circumferential wall of said member.

Preferably said cutting means is a drill bit and said segments are bit segments, said bit segments provided with a series of tapered and flat surfaces which face said series of surfaces formed on said member when said bit segments are retained between said insert and said member, each of said series of surfaces configured and juxtaposed so that said bit segments can slide relative to said member when in said cutting position in response to said drill being lifted from and lowered onto the bottom of a hole being drilled by said drill.

Preferably, said series of surfaces are further configured and juxtaposed so that a lower and of said bit segments can flax in a radial direction away from a central longitudinal axis of said member to abut said inner circumferential wall of said member when said drill is used as a core sampling drill and lifted from the bottom of said hole to break a core sample.

Preferably said seating means comprises a land extending circumferentially about said inner circumferential wall of said member for engaging an upper end of each segment, said land disposed adjacent and above an upper most one of said tapered and level surfaces formed on said member.

Preferably said system further comprises a tool dimensioned to travel through said ground drill and into said member for transporting said segments to and from said member, said tool being switchable between an installation mode in which segments are loaded onto said tool for installation in said member and a retrieval mode in which said tool is devoid of segments for retrieval of segments previously installed in said member; said tool provided with engaging means for engaging said insert whereby said tool can move said insert between said installation position and said retrieval position, new segments can be installed by switching said tool to said installation mode and lowering said tool into said drill to a position where said position of said tool extends beyond the lower end of said insert and said engaging means engages said insert wherein further downward movement of said tool moves said insert to said installation position in which said insert locates said segments in said seating means and retains said segments in said cutting position between said insert and said member whereafter said tool can be withdrawn to allow drilling to proceed.

Preferably, said tool comprises installation latching means and retrieval latching means for engaging said insert, said installation means being operable and said retrieval latching means being inoperable when said tool is in said installation mode and both said installation and said retrieval latching means being operable when said tool is in said retrieval mode, wherein, said installation means can engage said insert when said tool is lowered into said drill and said retrieval latching means can engage said insert when said tool is pulled upwardly a first distance so as to pull said insert upwardly said first distance, said retrieval latching means being disengaged automatically from said insert upon pulling said tool upwardly beyond said first distance.

Preferably said tool includes mode selecting means for switching said tool between said installation and retrieval modes, said mode switching means comprising a selector sleeve slidably and rotatably mounted on a body portion of said tool, and provided with installation apertures and retrieval apertures through which said installation latching means and said retrieval latching means can protrude respectively, wherein said selector sleeve can be rotated from a first position corresponding to the installation mode in which said installation apertures over-lie said installation latching means and said retrieval apertures are radially offset relative to said retrieval latching means and, a second position corresponding to said retrieval mode in which said installation apertures and said retrieval apertures over-lie said installation latching means and said retrieval latching means respectively.

Preferably said installation latching means engages said insert by way of abutment with one or more abutment surfaces formed near an upper end of said insert.

Preferably said upper end of said insert is profiled in a manner so that when said installation latching means contacts said upper end, said tool can be rotated about its longitudinal axis to align said tool, insert and segments so that said segments can be installed in or retrieved from between said insert and said member.

Preferably said insert is provided with a first detent for engaging said retrieval latching means and said system further includes means for disengaging said retrieval latching means from said first detent when said tool is pulled upwardly beyond said first distance.

Preferably said disengaging means comprises a tapered surface for compressing said retrieval latching means.

Preferably said tool comprises carrier means onto which said segments can be loaded for carrying said segments to and from said member, and wherein said tool is operable to cause said segments to slide relative to said tool body when said tool engages said insert whereby an upper end of said segments can extend laterally of said tool to engage said seating means and said insert.

Preferably said carrier means comprises a cradle about which said segments are radially spaced, said cradle being slidable relative to a portion of said tool when said tool is in said installation mode and said tool engages said insert, whereby upon relative sliding movement of said cradle and said portion of said tool, said upper end of the segments extend laterally of said tool for engagement by said seating means and said insert.

Preferably said system further comprises an elastic band surrounding said segments for retaining said segments on said tool, said elastic band acting to bias said segments toward a central longitudinal axis of said member when said segments are retained in said cutting position whereby, during retrieval of said segments, said elastic band assists in collapsing said segments onto said tool.

Preferably said cradle comprises an elongate shank extending from a lower tapered end of said body portion of said tool and being slidably housed within a bore in said body portion, and biasing means acting to retract said shank into said bore, wherein, in said installation mode and prior to engagement of said tool with said insert, said biasing means is held in compression and said shank extends from said bore so that the upper ends of said segments rest on said tapered end and upon engagement of said tool with said insert, said biasing means is released from compression thereby retracting said shank into said bore so that the upper ends of said segments slide along said tapered end to extend laterally of said tool.

Preferably said selector sleeve operates a second detent means for holding said biasing means in compression and wherein said selector sleeve is coupled to said installation latching means so that when said installation latching means engages said insert said selector sleeve slides relative to said tool body to release said second detent means thereby allowing expansion of said biasing means and retraction of said shank into said bore.

In an alternate embodiment, the system can be used for in situ replacement of a reamer of a ground drill where the reamer is composed of a plurality of separate segments. In this embodiment, the cradle comprises a plurality of recesses formed in said tool body, an upper end of each recess provided with a ramp leading to an outer surface of the body and, the selector sleeve being provided with a plurality of apertures which over-lie said segments in both said installation and retrieval modes with a radially inwardly directed lip provided at a lower end of each aperture for abutment with a lower end of each segment, whereby, when said installation latching means engages said insert with the tool in the installation mode, the selector sleeve can slide relative to the tool body so that said lips push said segments and the upper ends of the segments slide along said ramps to extend laterally beyond the tool to engage the seating means and the insert. In this embodiment, advantageously the seating means comprises a plurality of cut-outs formed radially about said member through which a cutting face of the segments can protrude to effect cutting of the ground.

In a further embodiment, a combined system is envisaged for in situ replacement of both a drill bit and a reamer of a ground drill in which the drill bit comprises a plurality of bit segments and the reamer comprises a plurality of reamer segments, the combined system comprising a first sub-system for replacement of bit segments and a second sub-system for replacement of said reamer segments, each sub-system including a tubular member, and insert in accordance with a first aspect of this invention wherein the member of the second sub-system is connected to a lower end of the drill and the member of the first sub-system is connected to the member of the second sub-system so that both the drill bit and reamer can be replaced simultaneously.

BRIEF DESCRIPTION OF THE DRAWINGS

Embodiments of the present invention will now be described by way of example only, with reference to the accompanying drawings in which.

.

DETAILED DESCRIPTION OF THE PREFERRED EMBODIMENTS

Figure 1:
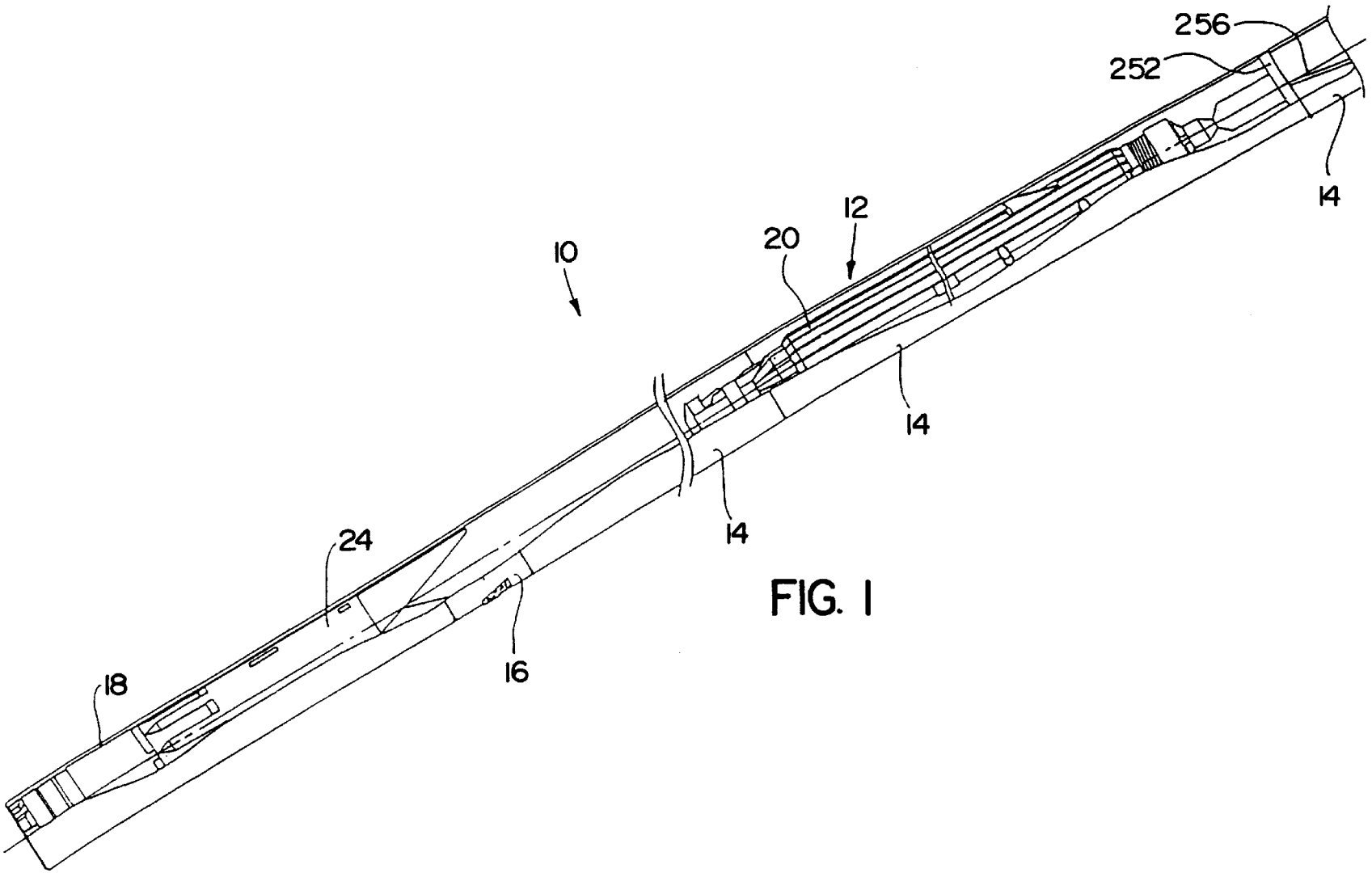
FIG. 1 is a side elevation view of a first embodiment of the system disposed within a ground drill.

FIG. 1 illustrates a first embodiment of a system 10 for the in situ replacement of cutting means in the form of a drill bit of a ground drill 12. The drill 12 is composed of a plurality of interconnected drill rods 14 which together form a drill string. A standard reamer 16 for reaming the circumferential wall of a hole being drilled is screwed to the free end of the lowest rod 14.

The system 10 comprises a number of separate but interactive components these including a tubular member taking the form of a drive sub 18 which is adapted for connection to a lower end of the drill 12, an installation and retrieval tool 20 dimensioned to travel through the drill 12 for carrying drill bit segments 22 (refer FIGS. 7*a*, 7*b*, and 9) to and from the drive sub 18 and, a substantially cylindrical insert 24 which is slidably retained within the member 18 between an installation position in which the insert retains the bit segments 22 in the drive sub 18 and a retrieval position in which the insert 24 is retracted to allow the bit segments 22 to collapse onto the tool 20 for withdrawal from the drill 12.

Figure 6A:
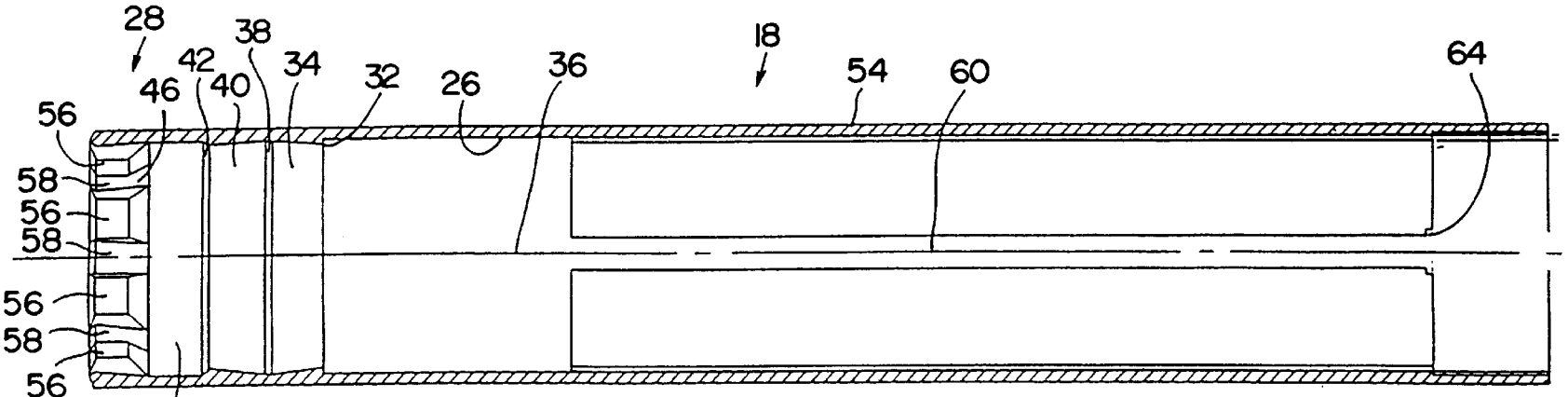
FIG. 6*a* is a longitudinal section view of a member used in the system shown in FIG. 1.
Figure 6C:
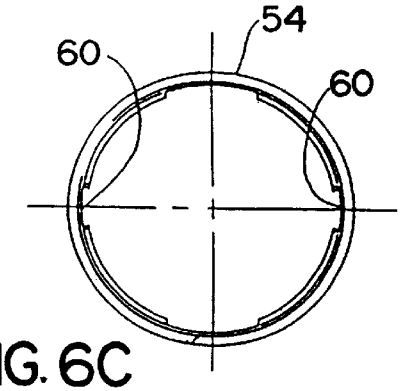
FIG. 6*c* is a view of an opposite end of the member shown in FIG. 6*a;*
Figure 6B:
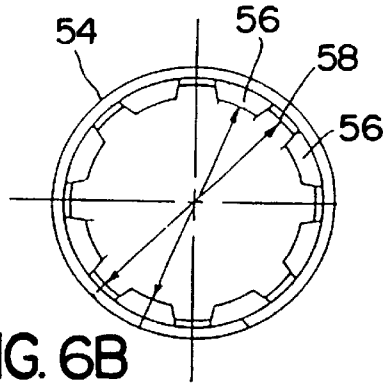
FIG. 6*b* is a view of one end of the member shown in FIG. 6*a;*
Figure 6D:
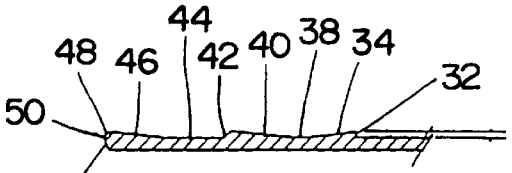
FIG. 6*d* is a view of a lower portion of the member shown in FIG. 6*a;*

Referring to FIGS. 6*a* and 6*d*, it can be seen that the inner circumferential wall 26 at a lower end 28 of the drive sub 18 is provided with seating means 30 for seating the bit segments 22. The seating means 30 includes a land 32 extending circumferentially about the inner surface 26 followed, in the downstream direction, with a series of tapered and flat surfaces and recess 58 formed on the lowermost one of those surfaces. Specifically, the land 32 is followed by the following sequence of surfaces in the down stream direction: surface 34 tapering away from a central longitudinal axis 36 of the drive sub 18; surface 38 extending parallel with axis 36; surface 40 tapering toward axis 36; surface 42 tapering away from axis 36; surface 44 extending parallel to axis 36; surface 46 tapering toward axis 36; and surface 48 tapering away from axis 36 and extending to the longitudinal extremity 50 of the drive sub 18. Contiguous with surface 48 is a surface 52 tapering away from both axis 36 and extremity 50 and which leads to outer circumferential surface 54 of the drive sub 18.

A plurality of drive lugs 56 are provided on surface 46. Adjacent drive lugs 56 define the recesses 58 in which a lower end of the bit segments 22 are held during drilling. As is most evident from FIG. 6*b*, the width of the drive lugs 56 reduces in the radial direction toward axis 36. A pair of opposed slots 60 extending parallel to axis 36 are machined in wall 26 inboard of the ends of the drive sub 18. A locking clip 62 (refer FIGS. 8*a* and 8*b*) is inserted into an upper end 64 of each slot 60. A lower end of each locking clip is formed with a surface 65 tapering toward the inner wall 26 and a spring clip 66 attached near an upper end of the clip on a surface opposite the inner wall 26.

As explained with reference to FIGS. 7*a*and 7*b*, the bit segments 22 are configured for mating with the seating means 30 of the drive sub 18. The bit segments comprise a shank 68 and a crown 70 formed at a lower end of the shank 68 for engaging and cutting the ground. The crown 70 typically comprises a matrix of diamonds and metal. In use, as ground engaging face 72 of the crown wears away fresh diamonds are exposed to facilitate cutting.

Side 74 (shown uppermost in FIG. 7*b*) of the bit segments 22 faces the inner surface 26 of the drive sub 18. The side 74 of shank 68 comprises the following sequence of surfaces starting from crown 70 (the axis 36 is shown in phantom for convenient reference in FIG. 7*a*); surface 76 tapering toward axis 36; surface 77 extending parallel to axis 36; surface 78 tapering away from axis 36; surface 80 tapering toward axis 36; level surface 82 extending parallel to axis 36; surface 84 tapering away from axis 36; surface 86 tapering toward axis 36; surface 80 extending parallel to axis 36. Surface 88 is followed by an abrupt step 90 which leads to surface 92 tapering toward axis 36 and extending to extremity 94 of the shank 68.

Opposite side 96 of shank 68 comprises the following sequence of surfaces in the direction from extremity 94 to crown 70: surface 98 tapering toward axis 36; level surface 100 extending parallel to axis 36; surface 102 tapering toward axis 36; and level surface 104 extending parallel to axis 36.

Figures 7A, 7B, 7C, 8A, 8B:
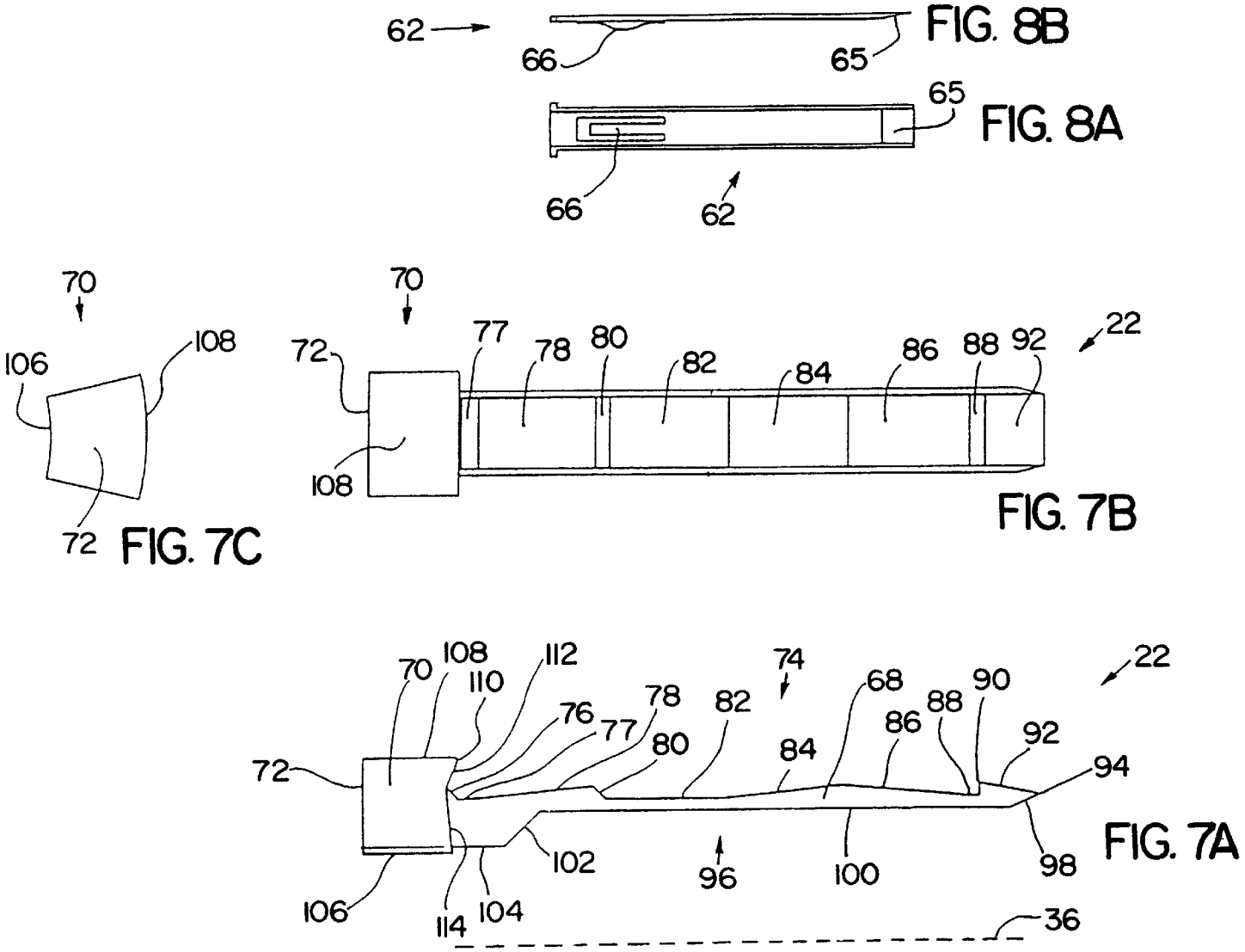
FIG. 7*a* is a side view of a bit segment used in the system shown in FIG. 1.
FIG. 7*b* is a top view of the bit segment shown in FIG. 6*a;*
FIG. 7*c* is an end view of the bit segment shown in FIGS. 7*a* and 7*b;*
FIG. 8*a* is a top view of a locking clip used in the system shown in FIG. 1.
FIG. 8*b* is a side view of the locking clip shown in FIG. 6*a;*
Figure 9:
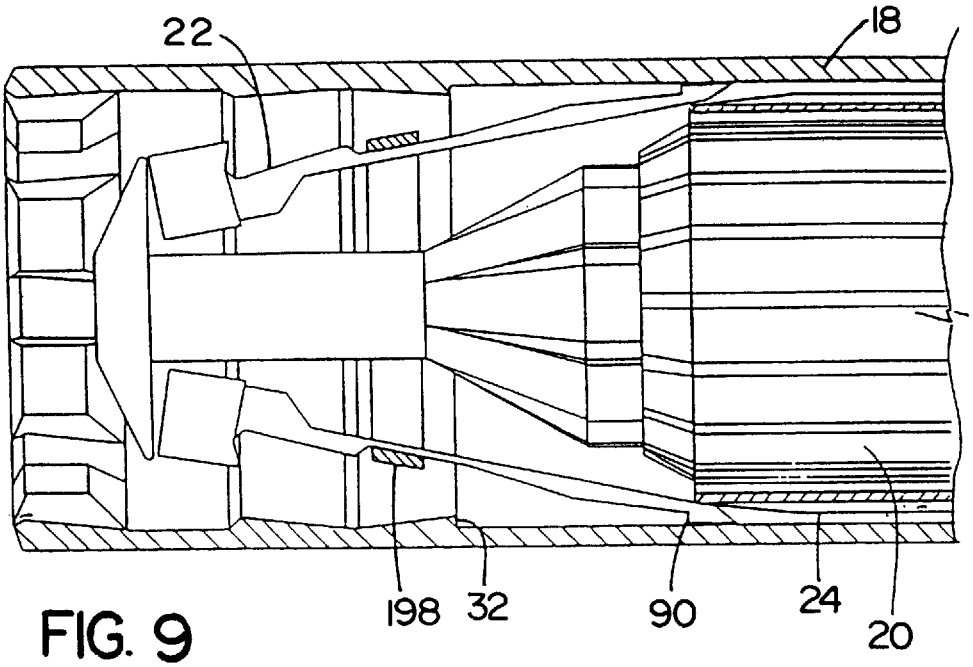
FIG. 9 is an enlarged partial section view of a lower end of the system.

As shown most clearly in FIG. 7*c,* the crown 70 is in the shape of a sector of an annulus and formed with inner and outer arcuate faces 106 and 108 respectively, with the length of face 108 being greater than that of face 106.

Figure 10:
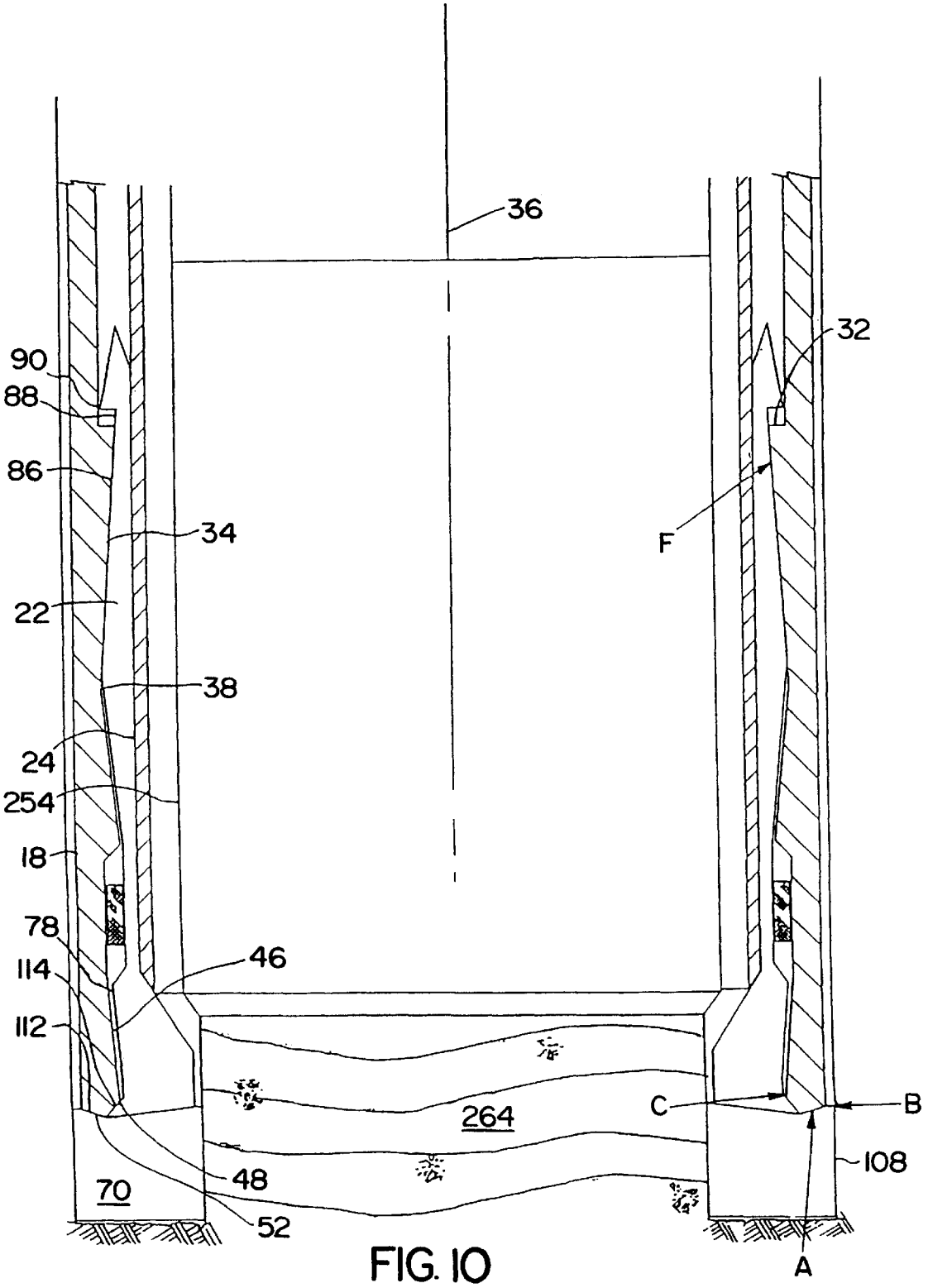
FIG. 10 is a sectional view of an end of the drill in a drilling mode with bit segments locked in a cutting position by the insert.

The face of the crown, 70 opposite cutting face 72 is provided with the following sequence of surfaces in the direction from outer face 108 to outer face 106: surface 110 extending parallel to cutting face 72; surface 112 inclined toward cutting face 72 and terminating adjacent surface 76 of shank 68; and surface 114 tapering away from cutting face 72 and terminating at arcuate face 106. Surfaces 112 and 76 form a V-shaped recess 116 which can engage the services 48 and 52 of the drive sub 18 (as seen in FIG. 10).

Referring to FIGS. 2–4*f*, the tool 20 comprises a main body portion 118 upon which a selector sleeve 120 is slidably and rotatably retained. An upper end 122 of body 118 is provided with a screw thread for attaching a standard wire line adaptor 124. A pair of opposing longitudinal grooves (not shown) are machined in body 118 at end 122 for slidably retaining a ring 126. The ring is provided on its inner circumferential surface with a pair of protrusions (not shown) which ride in the grooves to allow the ring 126 to slide longitudinally of the body 118. A spring 128 retained between the wire line adaptor 124 and ring 126 acts to bias the ring 126 and sleeve 120 away from end 122. A protrusion 130 is formed on an end of ring 126 adjacent the sleeve 120 for engagement in one of the two mode selector recesses 132, 134 cut in an adjacent end of the sleeve 120.

Body 118 is provided with an internal cavity 136 which houses a pair of installation latch dogs 138. Pin 140 extends through one end of both latch dogs 138 and couples the body 118 to the sleeve 120. The pin 140 resides in a longitudinal slot (not shown) formed in the body 118 and a transversely extending slot 142 formed in the sleeve 120. Each end of pin 140 sits on a lip 143 formed about the periphery of slots 142. This provides a connection between body 118 and sleeve 120 where the sleeve can slide longitudinally and rotate relative to the body 118.

A second pin 144 extends parallel to pin 140 and resides in a longitudinal slot 148 formed in the body 118. Spring 150 connects opposite ends of latch dogs 138 to the pin 144. The spring 150 biases the latch dogs 138 so as to extend laterally of body 118 and through apertures or slots 139 (refer FIGS. 4A, 4D) cut in sleeve 120. Each latch dog 138 is provided with a bearing face 152 for abutment with the insert 24.

A pair of retrieval latch dogs 154 similar to the insertion latch dogs 138 is also provided in the tool 20 on a side of the latch dogs 138 opposite end 122. However, the retrieval latch dogs 154 are located in a plane disposed perpendicular to that containing the insertion latch dogs 138. In addition, the retrieval latch dogs are orientated in an opposite sense to the insertion latch dogs 138. That is, ends 156 of retrieval latch dogs 154 are biased by a spring (not shown) to extend laterally of the body 118 and through apertures or slots 155 (refer FIGS. 4*a*, 4*e*) cut in sleeve 120 with opposite ends 158 being held by a pin 160 extending through the body 118. Bearing faces 162 are formed at ends 156 of the retrieval latch dogs 154 for engaging the insert 24.

Figures 4A, 4B, 4C, 4D, 4E, 4F, 4G:
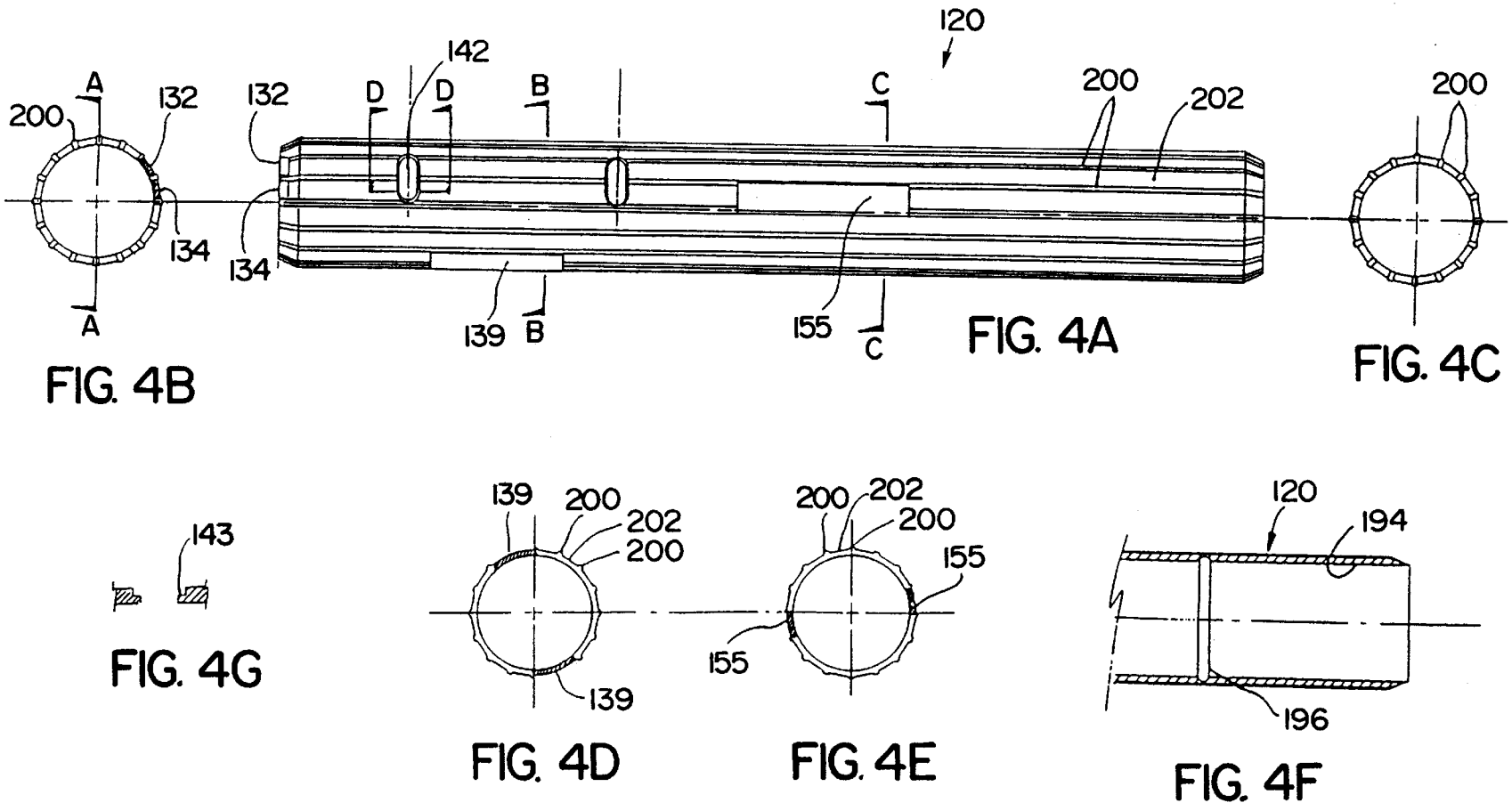
FIG. 4*a* is a side elevation view of a selector sleeve of the tool shown in FIGS. 2 and 3.
FIG. 4*b* is a end view of the sleeve shown in FIG. 4*a;*
FIG. 4*c* is a view of an opposite end of the sleeve shown in FIG. 4*a;*
FIG. 4*d* is a view of Section B—B shown in FIG. 4*a;*
FIG. 4*e* is a view of Section C—C shown in FIG. 4*a;*
FIG. 4*f* is a part view of Section A—A shown in FIG. 4*b;*
FIG. 4*g* is a view of Section D—D shown in FIG. 4*a;*

As is most evident from FIGS. 4*d* and 4*e*, the installation latch dog slots 139 are wider than the retrieval latch dog slots 155.

A rectangular cavity 164 is formed in the body 118 adjacent the retrieval latch dogs 154. Extending longitudinally of one end 166 of the cavity 164 is a hole 168 which communicates with cylindrical recess 170. Recess 170 extends through a frusto-conical shaped end 172 of the body 118. The cavity 164, hole 168 and recess 170 collectively form a slideway 174 for a cradle 176 upon which the bit segments 22 are attained.

The cradle 176 comprises a central bar 178 from which coaxially extends at one end a threaded stem 180 and terminates at an opposite end in a stop 182. The stem 180 extends through recess 170 and hole 168 into cavity 164. The end of the bar 178 adjacent the stem 168 is slidably received in recess 170. A spring 184 is retained on the stem 180 between a tension adjustment nut 186 screwed onto the stem 180 and end 166 of the cavity 164. Opposite ends 188 and 190 of the nut 186, are tapered or bevelled so as to reduce in thickness radially away from the centre of the nut 168.

A pair of locking pins (not shown) reside in respective recesses 192 formed in the body 118. The pins are retained within their respective recesses 192 by the sleeve 120 and have an end which can be selectively extended into and retracted from the recess 164 by virtue of relative movement of the sleeve 120. Referring to FIG. 4*f*, an inner circumferential wall 194 of the sleeve 120 is provided with a circumferential groove 196. When the sleeve 20 is positioned so that the groove 196 overlies the recesses 192, the ends of the pins therein can be retracted from the cavity 164 to allow extension of spring 184. However, the ends of the pins are held to extend into the cavity 164 by abutment of the pins with wall 194 when the sleeve 120 is positioned so that the groove 196 does not overlie the recesses 192. Under this condition, the pins abut against nut 186 maintaining the spring 184 in compression.

When loading the tool 20 to install the bit segments 22, the segments are disposed radially about the bar 178 with crowns 70 abuting the stop 182. Surface 98 of each bit segment 22 rests on the large diameter end of frusto-conical end 172 for the body 118. An elastic band 198 encircles the bit segments 22 about respective surfaces 82 to hold the bit segments onto the cradle 176.

A plurality of ridges 200 are provided on the outside surface of sleeve 120 extending parallel to the length of the sleeve 120. The ridges 200 are evenly spaced, with adjacent ridges defining shallow channels 202 through which a fluid can flow when the tool 20 is lowered through the drill 12.

Figure 5A:
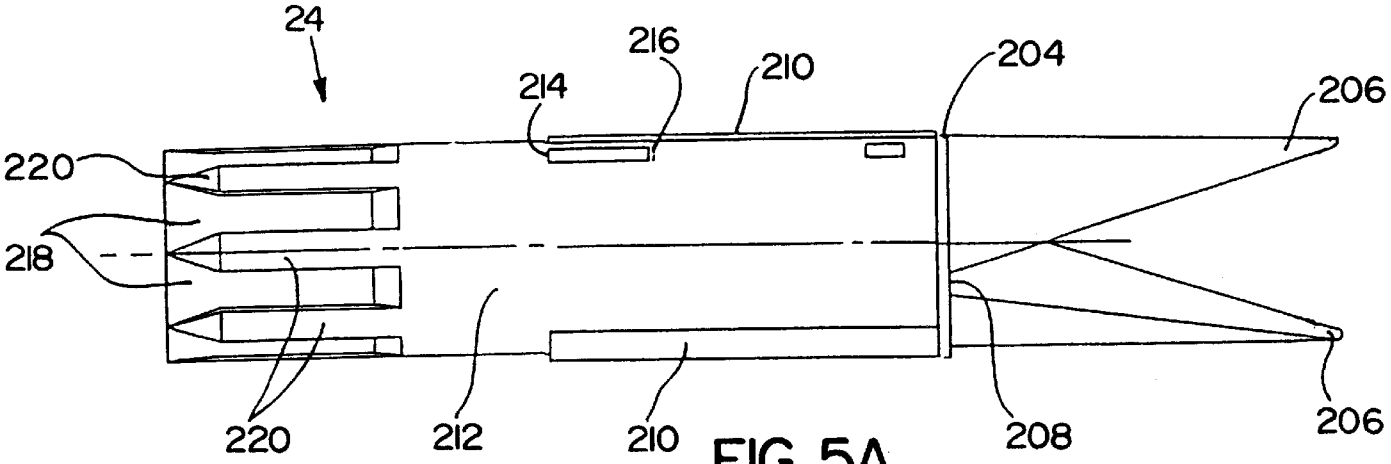
FIG. 5*a* is a side elevation view of an insert used in the system shown in FIG. 1.
Figure 5C:
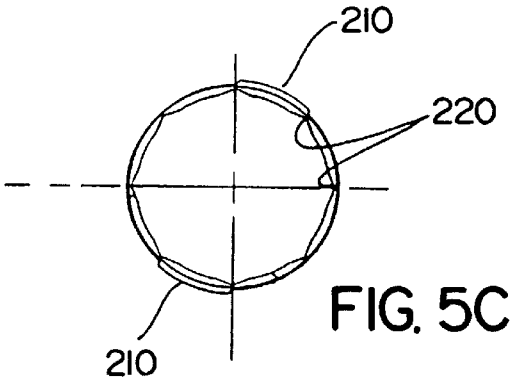
FIG. 5*c* is a view of an opposite end of the insert shown in FIG. 5*a;*
Figure 5B:
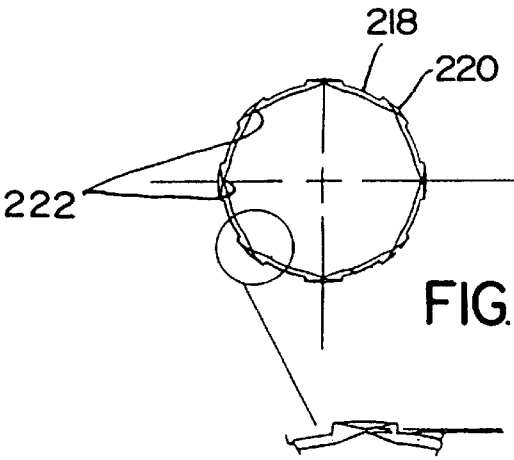
FIG. 5*b* is a view of one end of the insert shown in FIG. 5*a ;*

Insert 24 (refer FIGS. 5*a*–5*c*) is provided in the system 10 for expanding the bit segments 22 against the bias of elastic band 198 and locating the bit segments 22 into a cutting or drilling position against the inner surface of drive sub 18.

The insert 24 is in the form of a cylindrical tube having a pair of opposing peaks 206 extending from an upstream end 204. The sides of each peak slope sharply in the downstream direction and lead to flats 208 which separate the peaks 206. A pair of longitudinally extending rails 210 protrude from the outer circumferential surface 212 of insert 24. The rails 210 ride in the slots 60 in the drive sub 18. A pair of opposed detents in the form of longitudinally extending slots 214 (only one shown) are cut into the insert 24 for engaging the retrieval latch dogs 154. An upstream end of each slot 214 is bevelled so as to slope toward an inner surface of the insert 214 in the upstream direction. The end of the sleeve 24 opposite peaks 206 is provided with a plurality of longitudinally extending keyways 218. Adjacent keyways 218 are spaced apart by lugs 220. Waterways 222 are machined along the length of the inner surface of insert 24. The waterways provide a flow path for water used in bit cooling, lubrication and flushing.

Figure 13:
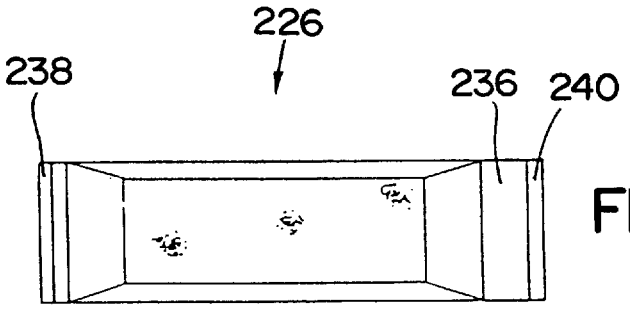
FIG. 13 is a top view of a reamer segment used in the second embodiment of the invention.
Figure 14:
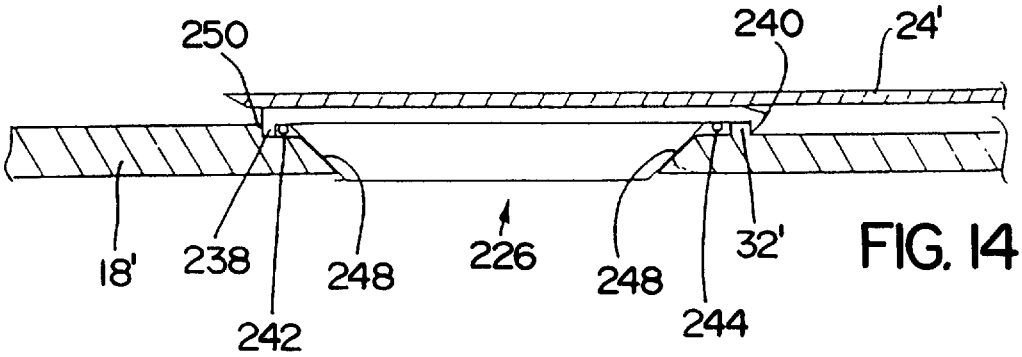
FIG. 14 is a partial sectional view of the second embodiment of the invention where the reamer segments are held in a cutting position.
Figure 12:
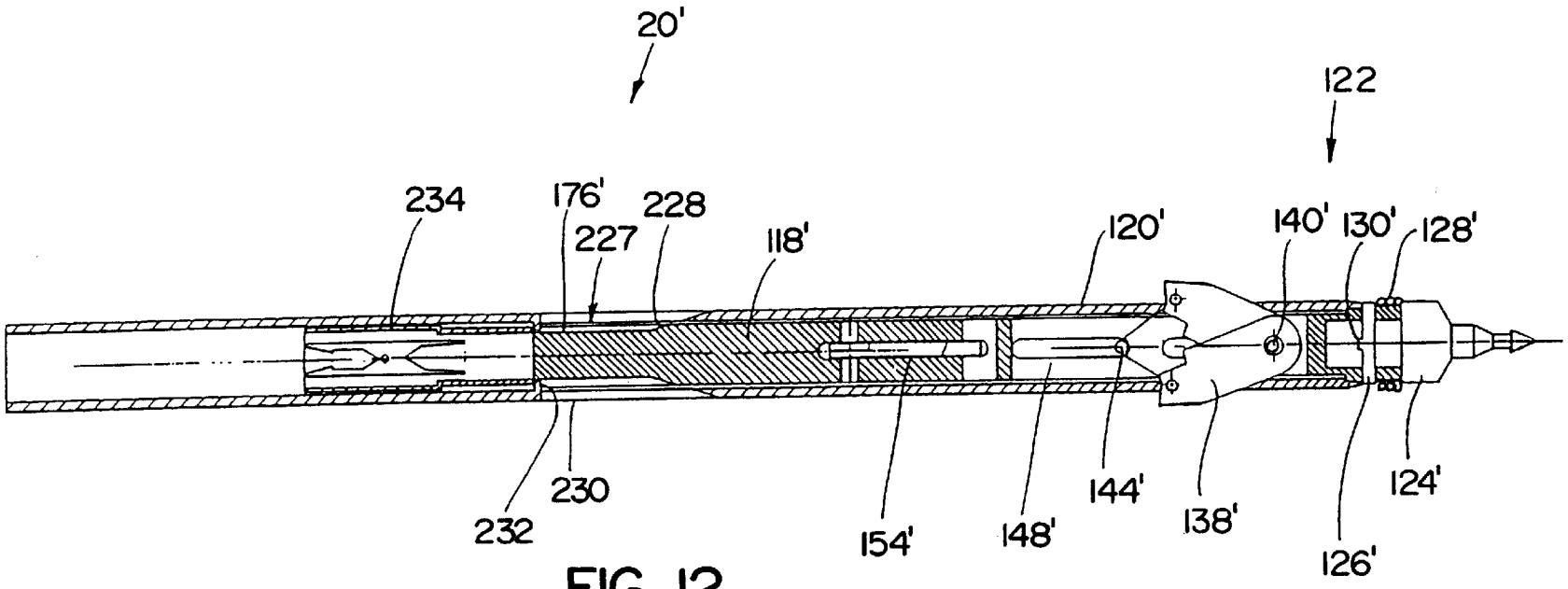
FIG. 12 is a sectional view of a tool used in a second embodiment of the present invention.

A tool 20' (refer FIG. 12) for replacing reamer segments (refer FIGS. 13 and 14) is structurally and functionally equivalent to the tool 20 used for replacement of drill bit segments 22. Accordingly, the reference numbers used in relation to the description of the tool 20 are also employed to denote similar features in the tool 20'. A wireline adaptor 124' is screwed onto upper end 122 of the tool 20'. Spring 128' interposes the wireline adaptor 124' and ring 126'. As with tool 20, the ring 126' is able to slide longitudinally of the tool 20' as provided with a protrusion 130 for engaging recesses (not shown) cut in an upper end of sleeve 120'. Installation and retrieval latch dogs 138' and 154' are identical to those of tool 20. The essential differences between tool 20' and tool 20 are that the cradle 176' comprises a plurality of cut-outs 227 formed radially about a lower end of body 118'. An upper end of each cut-out is provided with a ramp 228 which leads to the outer surface of body 118'. In addition, sleeve 120' is provided with a plurality of apertures 230 which overlie the cut-outs 227. A radially inwardly directed lip 232 is provided at the lower end of each aperture 230.

A further difference between tools 20 and 224 is the length of the slots in which the pins of the installation and retrieval latch dogs are retained. Specifically, the slots in tool 20' (see for example slot 148') are much longer than those of the corresponding slots in tool 20.

A standard overshot attachment 234 is connected to the lower end of tool 224 for connection with the wireline adaptor 124 of tool 20. This connection allows the tools 20 and 20' to rotate relative to each other.

Reamer segments 226 are retained in cut-outs 227 when being installed in or retrieved from the drill 12. Reamer segments 226 are in the shape of a rectangular prism having inclined sides. Each segment 226 is mounted on a rectangular plate 236'. Upstanding lips 238 and 240 extend across the upstream and downstream ends of the plate 326 respectively. Both lip 240 and the upstream end of the plate 236 are bevelled so as to converge toward each other in the upstream direction.

The segments 226 are retained in cut-outs 227 by rubber bands 242 and 244 which encircle plates 236 adjacent the ends of the corresponding segments 226.

A tubular member in the form of an auxiliary drive sub 18' is screwed onto the drill for holding the reamer segments 226 in a cutting position. Auxiliary drive sub 18' is provided with seating means comprising a land 32' protruding inwardly from an inner circumferential wall of drive sub 18' and cut-outs 246 (only one shown) having bevelled edges 248 for seating the bit segments 226. A recess 250 is cut into the inner surface of the drive sub 18 adjacent the downstream end of each cut-out 246 for accommodating the lips 238.

Auxiliary insert 24' is retained with auxiliary drive sub 18 for selectively holding the segments 226 in a cutting position and releasing the segments 226 for replacement. Insert 24' is essentially the same as insert 24 with the exception that it does not include the keyways 218 and lugs 220 of insert 24. Tool 20' is used to slide the insert 24' between an installation position in which the insert 24' locates and retains the segments 226 in the cutting position and, a retrieval position in which the insert 24' is retracted to release the segments so that they can collapse back onto the tool 226 by action of the elastic bands 242 and 244.

Figure 11:
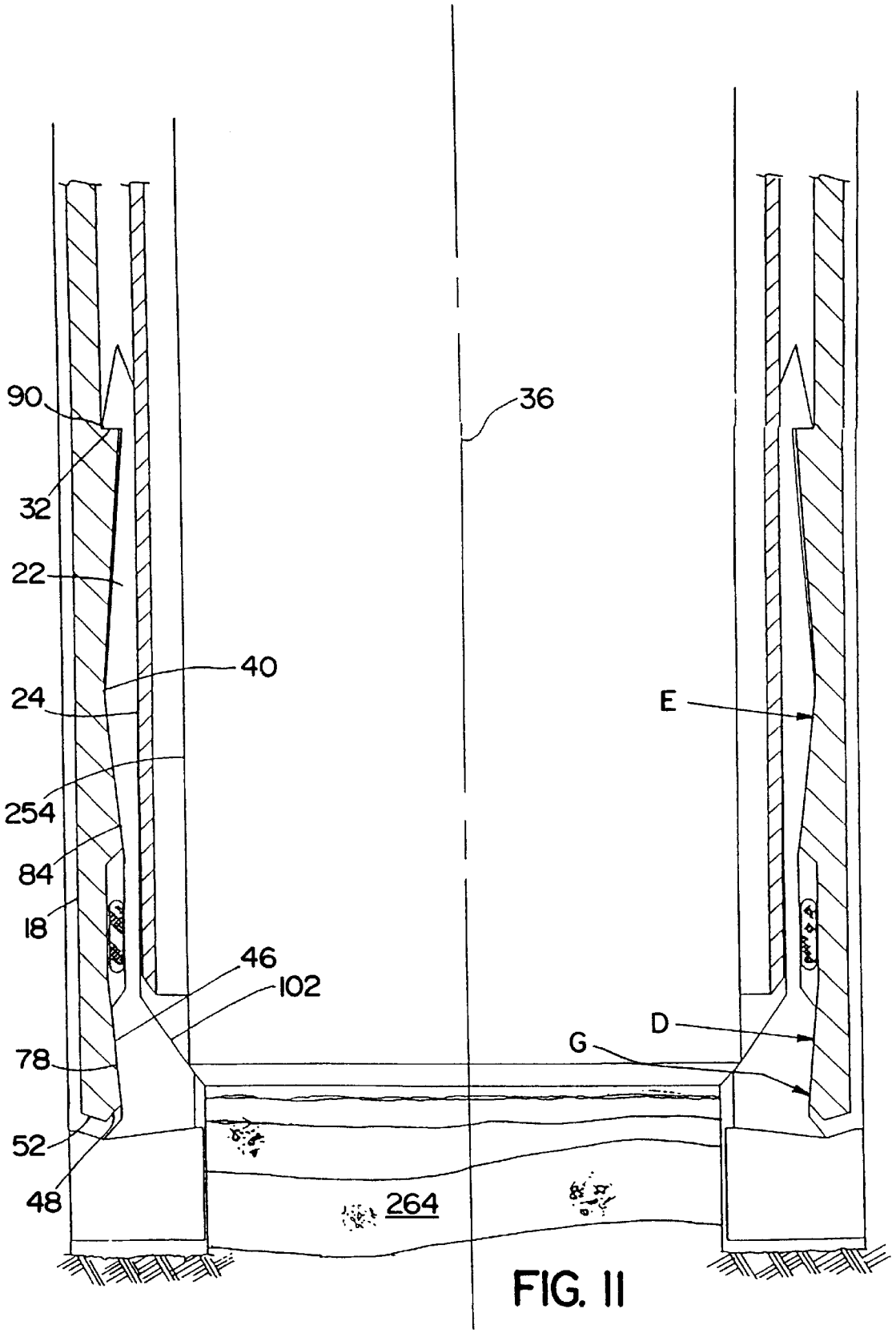
FIG. 11 is a view of the drill string shown in FIG. 10 but with the drill string pulled upwardly from a bottom of a hole being drilled.

Referring again to FIG. 1, the ground drill 12 is in this embodiment a core sampling drill such as for example, of the type manufactured by LONGYEAR. Core sampling drills typically include a landing ring 252 retained in a lower end of the drill 12. The landing ring 252 is used to halt the passage of a conventional core sample barrel 254 (refer FIGS. 10 and 11). The top of the core sample barrel 254 rests on the landing ring 252 preventing the core sample barrel 254 from falling out of the drill 12. The core sample barrel 254 is used to collect and retain a core sample of the ground being drilled. Once the core sample barrel is filled, drilling is stopped, the drill lifted from the bottom of the hole being drilled to break the core sample, then the core sample barrel lifted up through the drill 12 by a wire line 256.

When the system 10 is used for in situ replacement of a drill bit only, then the conventional core sampling drill bit (not shown) is replaced with drive sub 18 which threadingly engages reamer 16. In the event that the system 10 is also to be used to allow in situ replacement of the reamer, then the standard reamer 16 is also removed and replaced with drive sub 18'. Inserts 24 and/or 24' are always retained within corresponding drive subs 18 and 18'. Tools 20 and 20' are lowered and retrieved from the drill 12 for installing and retrieving bit segments 22 and 226 respectively. When tools 20 and 20' are removed, standard core sample barrel 254 can then be lowered into the drill 12 which passes through the inserts 24 and 24' for receiving a core sample. The method of operation of the system 10 will now be described in connection with the replacement of drill bit segments.

The drive sub 18 is screwed onto the reamer 16 of a standard core sampling drill. Tool 20 is set to the installation mode by turning sleeve 120 relative to ring 126 so that the protrusion 130 engages installation mode selector recess 132. Cradle 176 is extended from body 118 compressing the spring 184 which is held in compression by locking pins (not shown) having ends extending into the cavity 164. In this configuration, the installation latch dogs 138 extend laterally from slots 139 in the sleeve 120. However, the retrieval latch dogs 154 are not aligned with slots 155 and are therefore held in a compressed state within the confines of sleeve 120. Bit segments 22 are loaded onto the cradle 176 and held in place by elastic band 198 which contacts the surface 82 of each bit segment 22. Crown 70 of each bit segment abuts stop 182. The insert 24 is disposed within the drive sub 18 and held above the seating means 30 by clip 62. The insert 24 is orientated so that peaks 206 point in the upstream direction. Rails 210 of the insert 24 ride in slots 60 to allow the insert 24 to slide along the inside of the drive sub 18.

Figure 15:
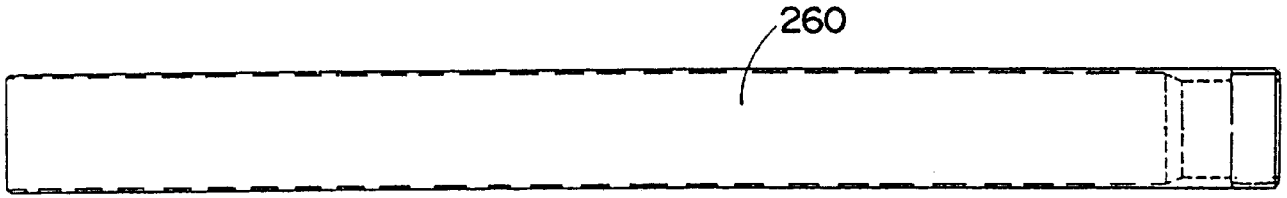
FIG. 15 is a side view of a transport sleeve for the system shown in FIG. 1; and, FIG. 16 is a side view of a transport sleeve deadweight for the system shown in FIG. 1.
Figure 16:
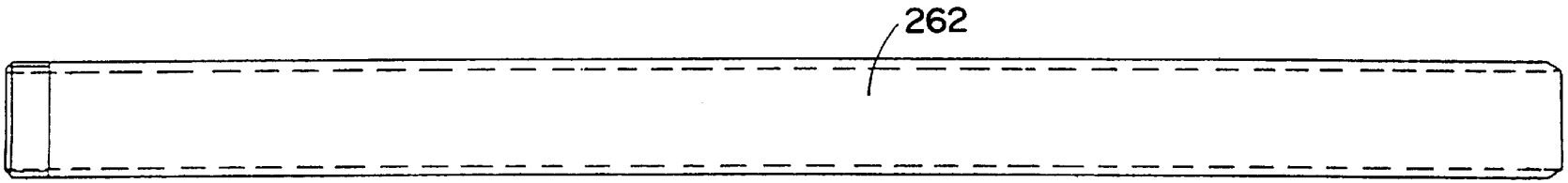

Tool 20 is connected to a standard wire line overshot via the wireline adaptor 124 and inserted into transport sleeve 260 (shown in FIG. 15) which compresses the installation latch dogs 138. Transport sleeve 260 together with tool 20 is then lowered through the centre of the drill 12. Transport sleeve dead weight 262 (refer FIG. 16) can be attached to an upper end of sleeve 260 to increase the rate of decent of tool 20. The decent of the transport sleeve 260 is halted by abutment with the landing ring 252. However, the tool 20 which has an outer diameter smaller than the inner diameter of the ring 252 continues its decent. As the tool 20 passes through landing ring 252, the installation latch dogs 138 are biased by spring 150 to extend from slots 139 formed in sleeve 120. Bearing faces 152 of latch dogs 138 contact peaks 206 causing the tool 20 to rotate until a position is reached where the bearing faces 152 reside on flats 208 separating the peaks 206. The rotation of the tool 20 ensures correct alignment of bit segments 22 with recesses 56 of the drive sub 18 and keyways 218 of the insert 24.

The latch dogs 138 are driven backward a short distance upon impacting with peaks 206 causing a corresponding movement in the sleeve 120. This action results in the groove 196 being located over recesses 192 so that the pins (not shown) residing therein are retracted from cavity 164 allowing spring 184 to expand. This in turn causes the cradle 176 to retract into the body 118. Surface 98 of each bit segment slides along the frusto-conical end 172 to extend laterally of the body 118 and contact inner wall 22 (refer FIG. 9). As tool 120 continues its decent, the step 90 of shanks 68 engage the land 32 on the drive sub 18.

The continued downward movement of the tool 120 also draws insert 24 downwards by virtue of the installation latch dogs 138 bearing on flats 208. When step 90 of each bit engages land 32 further downward movement of the bit segments 22 is prevented. The insert 24 collects the backside 96 of the bit segments and acts to expand the bit segments 22 outwardly in the radial direction against the bias of elastic band 198 locating the bit segments into separate recesses 58. The insert 24 continues to move downwardly until it reaches the installation position in which its keyways 218 slide over the bit segments 22 to retain the bit segments between the drive sub 18. Elastic band 198 resides in a cavity formed between surface 44 of the drive sub 18 and surface 82 of the bit segments 22.

Tool 20 can then be withdrawn via the wireline 256 to the landing ring 252 upon which, installation latch dogs 138 are compressed by being drawn backwards through ring 252. Tool 20 then re-enters the transport sleeve 260 and both are completely withdrawn from the drill 12.

The bit segments 22 locked about the drive sub 18 form a drill bit for cutting the ground. Standard core sample barrel 254 can then be lowered into the drill 12 via wire line 256 for holding a core sample of the ground being drilled. Insert 24 is dimensioned to allow the core sample barrel 254 (refer FIGS. 10 and 11) to pass therethrough.

With the bit segments 22 retained between drive sub 18 and insert 24 so as to form a drill bit, the drill 12 is lowered to the bottom of the bore hole being drilled and rotated to recommence drilling. Referring to FIG. 10 as the bit crowns 70 touch the bottom of the hole, bit segments 22 are forced to slide backward with surfaces 34, 48 and 52 of the drive sub bearing against surfaces 86, 112, and 114 of the bit segments respectively. In this mode, (drilling mode) steps 90 are spaced above the land 32. The sliding motion of the bit segments is facilitated by surfaces 77 and 88 of the bit segments, and surface 38 of the drive sub, all of which extend parallel to axis 36.

The arrangement of surfaces on the bit segments 22 and drive sub 18 transfers the bit weight and internal/external rotational forces created during drilling to the drive sub 18. Furthermore, this action locks the insert 24 in place by means of a clamping action as the uppermost inside edge of each bit segment is forced slightly inwardly, against the outer circumferential wall 212 of the insert 24.

The transfer of forces during drilling between the bit segments 22 and drive sub 18 are also shown in FIG. 10 and are described hereinafter. Arrow A shows the direction of transference of a portion of the string weight from the bit crown 70 to the drive sub 18 during drilling. This force is directed in the longitudinal direction of drive sub 18 and is applied to surfaces 48 and 52. The remainder of string weight is transmitted through surface 86 of each bit segment to surface 34 of each keyway as shown by Arrow F in FIG. 10. This force also causes the bit segments 22 to move radially inwards so as to provide the clamping action against insert 24 required during drilling.

External radial force acting on face 108 of crowns 70 transferred to the drive sub by surface 52 as shown by arrow B. These forces are also borne by surfaces 52 and 48 of the drive sub 18. Internal radial forces on the bit crown 70 and drive lugs 56 are transferred to the drive sub via surface 48 as indicated by arrow C.

During core breaking (shown in FIG. 11) when the drill 12 is lifted from the bottom of the borehole, the bit segments slide relative to the drive sub 18 until steps 90 abut land 32, with surfaces 40 and 46 of the drive sub bearing against surfaces 84 and 78 of the bit segments respectively. The core sample barrel 254 also exerts a force against surface 102 of the bit segments 22. This force is transmitted in a diagonal direction inclined toward the bottom of the bore hole from the bit segments 22 to the drive sub 18 between respective surface pairs 77 and 46; and, 84 and 40 as shown by arrows D, E and G.

A space or gap between surfaces 78 and 46 on the bit segments 22 and drive sub 18 respectively (shown in FIG. 10) allows the bit segments 22 to flex radially outwardly when the core sample barrel 254 exerts a force on the bit segments 22 during core breaking. This spreads the bit segments radially away from axis 36 during core breaking and allows the core sample to be broken from the rock formation being drilled in the conventional manner via a core sample barrel lifter (not shown).

During drilling, as explained above, the insert 24 locks the bit segments 22 in place by a clamping action as the upper most inside edge of each bit segment is forced slightly inwardly against the outer circumferential wall 212 of insert 24.

Relational drive is rotated from the drive sub 18 to the bit segments 22 via drive lugs 56.

Bit lubrication and cooling is provided in the conventional manner with fluid being pumped into the drill 12 and channelled via internal waterways 222 of insert 24 which allows the fluid to reach the bit crown 70. However, cooling at the bit crown 70 is substantially different to that achieved with standard drill bits. Extremely wide waterways are automatically provided in the present system 10 by the gaps formed between adjacent bit segments 22.

In conventional drill bits, relatively narrow channels or grooves are cut in the crown to allow for the passage of lubricating and cooling fluid. The gaps between the bit segments 22 in the present embodiment, represent an increase of between 300% to 600% of the waterway width in comparison with standard drill bits. Conversely, there is a substantial reduction in the surface area of the bit crown 70. This is contrary to standard practice of bit matrix design. It is believed that the present arrangement of drill bit segments provides more efficient cutting as cooling, flushing of contaminants, and lubrication is achieved more efficiently and at lower pump pressures. The crown design also affords an increased penetration rate by virtue of the concentration of the drill weight onto a smaller cutting area. The extra wide waterways between adjacent bit segments also negate the problem of bit waterway blockage and lost circulation caused by burring of the bit crown or contamination by drill cuttings.

To retrieve and replace bit segments 22, the drill 12 is initially lifted a short distance off the bottom of the hole so as to break a core sample from rock formation 264. The core sample barrel 254 is then removed from the drill by use of wireline 256 in the conventional manner.

Tool 20 is placed into the retrieval mode by means of a counter-twist of sleeve 120 so that the retrieval recess 134 engages protrusion 130. This results in slots 155 being aligned with the retrieval latch dogs 154 which become fully expanded and extend beyond the surface of sleeve 120. The tool 20 is inserted into transport sleeve 260 and lowered through the drill 12. Upon reaching the landing ring 252, the decent of sleeve 260 is halted but the tool 20 continues through the landing ring 252 exposing the retrieval and installation latch dogs 138, 154 which contact inner circumferential wall of the drill 12.

Tool 20 then enters the insert 24 and in doing so results in the retrieval latch dogs being compressed by contact with the inner circumferential wall of the insert 24. The installation latch dogs 138 contact peaks 206, rotating the tool into correct alignment in the drive sub 18. As the installation latch dogs 138 bottom out on the flats 208, the retrieval latch dogs 154 expand into slots 214 provided in the insert 24. Cradle 176 is in an extended position with spring 184 compressed and nut 186 locked against linear movement by the locking pins (not shown) residing in recesses 192. Cradle 176 is disposed centrally of the bit segments 22 with stop 182 extending beyond the bit crowns 70. As the tool 20 is now lifted a short distance by a wireline 256, the retrieval latch dogs 154 draw back the insert 24 which slides along slots 60 in drive sub 18. Simultaneously, the bit segments 22 are released and collapse onto cradle 176 by contraction of the elastic bands 198. Upon further upward pulling of the tool 20 the retrieval latch dogs 154 are disengaged automatically from insert 24 by being compressed by tapered surfaces 65 on the clip 62.

As the tool continues its upward movement, it leaves the insert 24 and both the retrieval latch dogs and installation latch dogs contact the inner circumferential wall of the drill 12. On reaching the landing ring 252, the installation latch dogs are compressed against the bias of spring 150 so as to pass through ring 252. In order to compress the retrieval latch dogs 154, the faces 162 together with the lower end face of landing ring 252 are provided with bevelled or tapers so that an abutment of the retrieval latch dogs with the landing ring, the application of an upward force will result in the retrieval latch dogs being compressed so as to pass through the landing ring 252.

The tool 20 then re-enters the transport sleeve 260 and together therewith is pulled to the surface. The bit segments 22 can then be removed from the cradle 176 and new drill bits can be attached hereto for installation on the drive sub 18.

Figure 2:
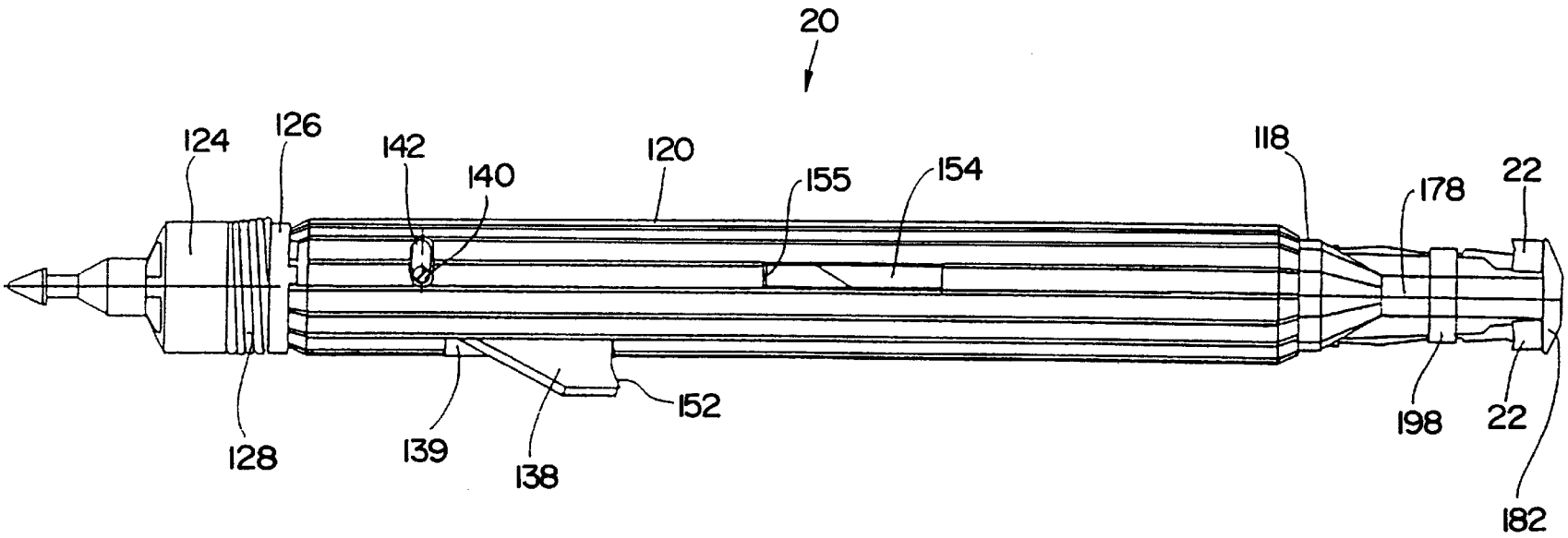
FIG. 2 is a side elevation view of a tool used in the system shown in FIG. 1.
Figure 3:
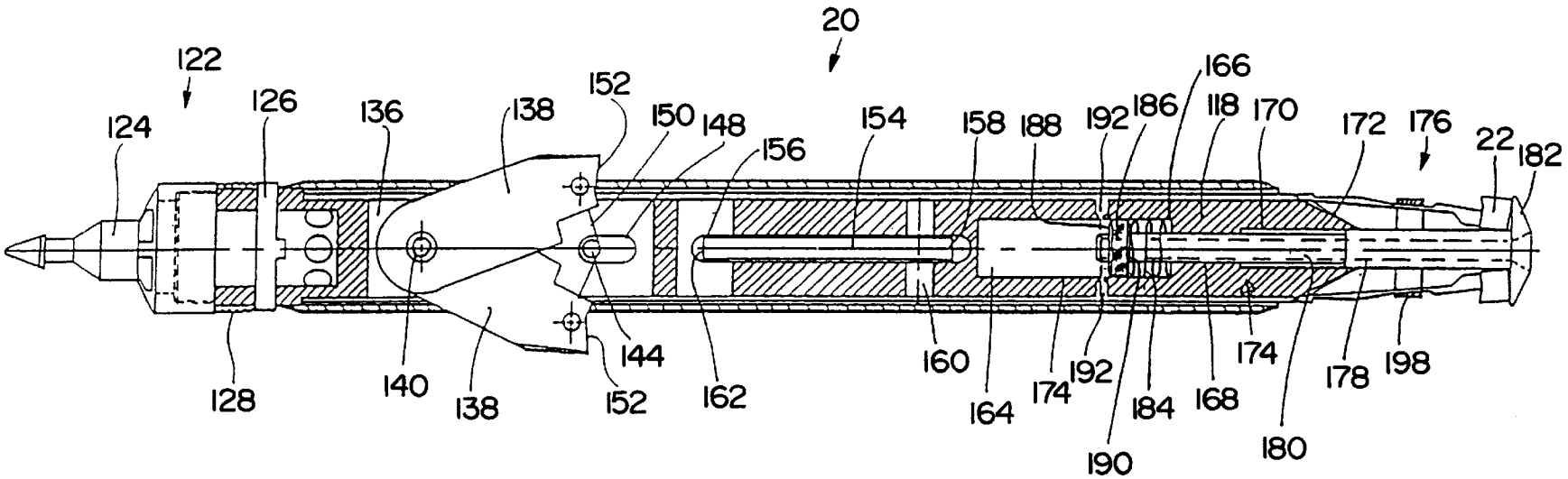
FIG. 3 is a longitudinal section view of the tool shown in FIG. 2.

In situ replacement of the reamer segments 226 by interaction of the reamer tool 20', auxiliary drive sub 18' and auxiliary insert 24' is essentially identical to that described above with reference to the bit segments 22. The only substantive difference between the two being in the operation of the cradle 176'. Referring to FIG. 2, reamer segments 226 are placed within the recesses 227 of cradle 176. When installation latch dogs 138 impact on the peaks of insert 24', sleeve 120' is forced backward, that is in the upstream direction. Accordingly, lips 232 on the sleeve 120' abut lips 238 of plate 236. This causes the reamer segments 226 to slide along ramps 228 so that lip 240 extends laterally of the outer surface of sleeve 120'. In this way, lip 240 can then contact land 32' to halt further downward movement of the reamer segments 226. Retrieval of the reamer segments is achieved in the same manner as for the bit segments.

When it is desired to incorporate replaceable reamer segments in the drill 12, the standard reamer 16 is replaced with drive sub 18'. The reamer segments 226 typically would be changed simultaneously with drill bit segments 22 by connecting the wireline overshot 234 of tool 20' with the wireline adaptor 124 of tool 20. This allows relative rotation of tools 20 and 20'. While reamer segment and bit segment replacement would occur simultaneously, the reamer segments would not be replaced as often as the bit segments. When the reamer segments are not being replaced, tool 20' is left in the installation mode and no reamer segments 226 are loaded onto the cradle 176'.

It is apparent from the above description that the present invention enjoys numerous advantages and benefits over the prior art. Most importantly, it allows easy and very quick replacement of the drill bit and reamer without the need to withdraw the string from the hole, thereby reducing downtime, increasing productivity, and reducing drilling costs. The ease and simplicity of changing the drill bit also encourages the changing of drill bits in conjunction with variations in sub-strata in order to optimise bit hardness and characteristics with the sub-strata encountered. In this regard, it is known for drill bits to be completely worn when drilling through sub-strata of a depth of less than 1 meter when that drill bit is not specifically designed for the sub-strata encountered. In addition, the unique shape and configuration of the drill bits in conjunction with the keyways of the drive sub and configuration of the insert performs the following major functions:

1. The tapered surfaces on the bit segments and drive sub transmit the load forces experienced on the bit crown during lifting of the drill string to break and retrieve the core sample evenly throughout the drive sub 18 thereby' negating the possibility of snapping the bit segments 22.
2. The surfaces on side 74 of bit segments 22 in conjunction with the drive lugs 56 and insert 24, transmit the string weight and rotational torque experienced during drilling, evenly throughout the entire drive sub assembly.
3. The surfaces of the drive sub 18 and bit segments allows the bit segments to slide between the drive sub 18 and insert 24 when the drilling operation changes from drilling mode to core breaking mode which provides for easy snap-over locking and unlocking of the bit segments during installation and retrieval.
4. The surfaces of the drive sub 18 and the base of the bit crown 70 also serves to counteract the internal/external radial forces experienced by the bit crown during drill rotation.
5. The sliding and non-tight fit of the bit segments into the drive sub allows ease of insertion and retraction. This also negates problems associated with contamination of parts with drilling fluid or cuttings.
6. The use of mating tapered surfaces instead of threads allows for maximum design strength along the full length of each bit segment 22 to get a very robust and simple bit segment design.
7. The back and forth movement provided for in the design of the drive sub 18, and experienced when the drill is lifted off the bottom of the borehole, or engages the bottom of the borehole, automatically and continually defouls the bit segments. It will also automatically correct any jamming of bit segments, caused by contamination of the like which may occur in drill certain formations.
8. The interaction between the surfaces of the bit segment and keyways also automatically lock the insert 24 in the drilling mode the moment the bit crown 70 touches the bottom of the borehole, and releases the insert the moment the drill sting is lifted off the bottom of the borehole.

We claim:

1. An insert for releasably retaining cutting means in a ground drill, said insert comprising a substantially cylindrical member movable within said ground drill between an installation position in which said insert retains said cutting means in a cutting position between an outer circumferential surface of said insert and an inner circumferential surface of said ground drill, and a retrieval position in which said insert is retracted to release said cutting means from between said outer circumferential surface of said insert and said inner circumferential surface of said ground drill.

2. An insert according to claim 1, further comprising a plurality of radially spaced and longitudinally extending keyways formed about said outer circumferential wall and at a lower end of said member for receiving said cutting means in retaining said cutting means and said cutting position.

3. An insert according to claim 2, wherein an upper end of said insert is profiled to cause rotation of said cutting means about a longitudinal axis of said drill when said cutting means is being installed in said ground drill to thereby align said cutting means with said keyways.

4. An insert according to claim 3, wherein said upper end of said insert is provided with two opposing peaks adapted to contact a tool used for transporting said cutting means to and from said ground drill, whereby, in use, when said tool abuts said peaks, said tool can be rotated about the longitudinal axis of said drill to thereby align said cutting means with said keyways.

5. An insert according to claim 4, further comprising guiding means for guiding said insert to move in a longitudinal direction between said installation position and said retrieval position.

6. An insert according to claim 3, wherein said guiding means comprises a rail or a channel formed on said outer circumferential surface of said insert adapted for engaging a channel or a rail, respectively formed on said inner circumferential surface of said ground drill.

7. An insert according to claim 6, further comprising a plurality of longitudinally extending channels from in an inner circumferential surface of said insert to provide a flow path for fluid used for cooling and lubricating said cutting means when said ground drill is operated to drill a hole.

8. An insert according to claim 4, further comprising a first detent for engaging said tool when said tool is initially moved upward a first distance so as to move said insert to said retrieval position.

9. An insert according to claim 8, further comprising disengaging means for disengaging said tool from said detent when said tool is pulled upwardly beyond said first distance.

10. An insert according to claim 9, wherein said first detent is a recess cut in said cylindrical member.

11. An insert according to claim 10, wherein said disengaging means comprises a tapered surface leading, in the upward direction, from said recess to an inner circumferential surface of said cylindrical member.

* * * * *